United States Patent [19]

Kasamatsu et al.

[11] Patent Number: 4,725,180

[45] Date of Patent: Feb. 16, 1988

[54] APPARATUS FOR HANDLING SIGNATURES BEFORE BINDING

[75] Inventors: Tamotsu Kasamatsu, Osaka; Koh Yatsuka, Amagasaki, both of Japan

[73] Assignee: Shin Osaka Zoki Co., Ltd., Osaka, Japan

[21] Appl. No.: 15,413

[22] Filed: Feb. 17, 1987

[30] Foreign Application Priority Data

Feb. 17, 1986 [JP] Japan ..... 61-32649
Jan. 7, 1987 [JP] Japan ..... 62-2035

[51] Int. Cl.[4] ..... B65G 57/00; B65H 31/38

[52] U.S. Cl. ..... 414/31; 414/35; 414/36; 414/46; 414/49; 414/96

[58] Field of Search ..... 414/31, 35, 36, 46, 414/49, 92, 96, 98, 56

[56] References Cited

U.S. PATENT DOCUMENTS 3,115,090 12/1963 Elander ..... 414/96 X
3,599,807 8/1971 Hedrick et al. ..... 414/35 X
4,432,685 2/1984 Stauber ..... 414/31

FOREIGN PATENT DOCUMENTS 59-128158 7/1984 Japan .
60-15352 1/1985 Japan ..... 414/31
609306 2/1979 Switzerland ..... 414/31

*Primary Examiner*—Frank E. Werner
*Assistant Examiner*—Janice Krizek
*Attorney, Agent, or Firm*—Armstrong, Nikaido, Marmelstein & Kubovcik

[57] ABSTRACT

This invention provides an apparatus for handling signatures before binding comprising a signature stacking unit for piling signatures delivered from a rotary press or the like into stacks of a given number of signatures, a liftable table for receiving the stacks from the stacking unit, a stack collecting unit for piling up a number of signature stacks, a lateral feed member for pushing the stack as placed on the table to a specific position, and a turntable rotatable through an angle of 180° in a direction about a vertical axis and reversibly rotatable through an angle of 90° about the axis for horizontally rotatingly reversing stacks of signatures, the apparatus being characterized in that the liftable table is connected to a hydraulic cylinder-plunger for lifting the table, the liftable table being of the divided type and upwardly and downwardly movable without contacting a hydraulic cylinder-plunger for driving the lateral feed member, the liftable table for receiving the signature stack laterally delivered from the liftable table by the lateral feed member, the turntable being provided with an upward feed member for upwardly transporting the signature stack from the turntable to the position of the stack collecting unit.

4 Claims, 15 Drawing Figures

APPARATUS FOR HANDLING SIGNATURES BEFORE BINDING

The present invention relates to an apparatus for handling a multiplicity of signatures before stacks of signatures are bound with a band or the like, i.e. for piling signatures into stacks of a given number of signatures, heaping up a number of such stacks into a combined stack and horizontally reversing the signature stacks one after another to position the folds of the signatures of the stacks alternately at opposite sides before the stacks are so accumulated. More particularly, the invention relates to an apparatus for handling signatures before binding which comprises a signature stacking unit for piling signatures delivered from a rotary press or the like in the preceding process into stacks of a given number of signatures, a lift table disposed in a fixed position for receiving the stacks from the stacking unit, a stack collecting unit provided in a fixed position for stacking a number of signature stacks, lateral feed means for pushing the stack as placed on the lift table to a position below the stack collecting unit, and a turntable rotatable through an angle of 180° in a direction about a vertical axis and reversibly rotatable through an angle of 90° in opposite directions about the axis for horizontally rotatingly reversing stacks of signatures to position the folds of the signatures of the stacks alternately at opposite sides in the order of stacking before the stacks are heaped up.

The signature handling apparatus of the type described includes the turntable for the following reason.

The signature is more bulky at the fold thereof than at the opposite cut end, so that if a multiplicity of signatures are stacked up as oriented in the same direction, the stack becomes unstable. When many stacks of signatures are to be further stacked up, therefore, there arises a need to horizontally rotatingly reverse the stacks to position the folds of signatures of the stacks alternately at opposite sides in the order of stacking. The turntable is used for this purpose.

We have already proposed in Unexamined Japanese Patent Publication SHO 59-128158 such a signature handling apparatus which comprises a turntable serving also as a lift table and disposed in a fixed position below the signature stack on a signature stacking unit and adjacent to a pusher provided in a fixed position and serving as means for laterally feeding the stack.

With this prior-art apparatus, signature stacks delivered from the signature stacking unit are transferred to a position for delivery to a stack collecting unit by the table and the pusher. For this purpose, the table, upon receiving the stack from the stacking unit, is lowered to a specified position opposed to the pusher, and the pusher is then advanced to laterally feed the stack from the table to the stack collecting unit and is thereafter retracted. In preparation for receiving the next signature stack, the table is subsequently raised to a position immediately below the stack on the stacking unit. The table is not liftable on advancement of the pusher or during the retraction thereof in order to shorten the lateral stack feed cycle because if lifted on advancement or during the retractiion thereof, the table would collide with the hydraulic cylinder-plunger means for moving the pusher forward and rearward.

An object of the present invention is to overcome the drawback of the prior art and to provide an apparatus for handling signatures before binding comprising a lift table which is liftable on advancement or during the retraction of the lateral feed means free of interference with the hydraulic cylinder-plunger means for driving the lateral feed means so as to shorten the lateral stack feed cycle.

Another object of the present invention is to provide an apparatus for handling signatures before binding which is adapted to feed signature stacks to a stack collecting unit for stacking up a number of signature stacks so that the stacks will be piled up zigzag as displaced from one another to a predetermined degree in specified directions alternately in the order of piling.

Another object of the invention is to provide an apparatus which is usable for handling at least two different kinds of signatures before binding.

The present invention provides an apparatus for handling signatures before binding which includes a signature stacking unit for piling signatures delivered from a rotary press or the like in the preceding process into stacks of a given number of signatures, a liftable table disposed in a fixed position for receiving the stacks from the stacking unit, a stack collecting unit provided in a fixed position for piling up a number of signature stacks, lateral feed means for pushing the stack as placed on the table to a position below the stack collecting unit, and a turntable rotatable through an angle of 180° in a direction about a vertical axis and reversibly rotatable through an angle of 90° in opposite directions about the axis for horizontally rotatingly reversing stacks of signatures to position the folds of the signatures of the stacks alternately at opposite sides in the order of piling before the stacks are piled up, the apparatus being characterized in that the liftable table is connected to hydraulic cylinder-plunger means for lifting the table to take the form of a frame defining a space for passing the lateral feed means therethrough, the liftable table being of the divided type and upwardly and downwardly movable without contacting hydraulic cylinder-plunger means for driving the lateral feed means, the turntable being disposed in a position below the stack collecting unit and adjacent to the liftable table for receiving the signature stack laterally delivered from the liftable table by the lateral feed means, the turntable being provided with upward feed means for upwardly transporting the signature stack from the turntable to the position of the stack collecting unit.

According to the present invention, the signature stacking unit and the lateral feed means may be those disclosed in the foregoing publication, i.e. Unexamined Japenese Patent Publication SHO No. 59-128158. The stack collecting unit comprises an enclosure for guiding and accepting the signature stack upwardly transported by the upward feed means, and support means retractable to a position permitting the upward transport of the stack when the stack is transported into the enclosure and movable to a position for receiving the signature stack placed into the enclosure when the upward feed means lowers after upwardly transporting the stack. The support means holds the signature stacks placed batchwise into the enclosure by the upward feed means every time each stack is so transported. Thus, a number of signature stacks are placed batchwise and consequently accumulated into a combined stack. A known stack collecting unit of this type is usable in the present invention.

According to the present invention, the liftable table and the turntable are provided separately. The liftable table is connected to hydraulic cylinder-plunger means for lifting the table to take the form of a frame defining a space for passing the lateral signature stack feed means therethrough. The liftable table is of the divided type and is movable upward and downward without contacting hydraulic cylinder-plunger means for driving the lateral feed means. Accordingly, the liftable table is upwardly movable free of interference by the lateral feed means while the lateral feed means is retracting after laterally feeding the signature stack. Thus, the advancement or retraction of the lateral feed means and the rise of the liftable table can be effected at the same time, consequently shortening the lateral signature stack feed cycle.

The apparatus of the invention has another feature in that the turntable is movable forward and rearward in directions perpendicular to the direction of lateral feed of the signature stack. The turntable is provided with means for effecting this movement. When required, the turntable thus movable is moved in the specified directions by a predetermined amount to feed signature stacks to the stack collecting unit so that the stacks will be heaped up zigzag as displaced from one another to the predetermined degree in the specified directions alternately in the order of heaping. When signature stacks are piled up in such a zigzag arrangement, the folds of the signatures are positioned in recessed portions formed by stacking and are consequently protected from damage due to contact with other articles after the combined stack has been bound with a band or the like.

According to another feature of the present invention, the apparatus is provided with fences mounted on the turntable and positioned in corresponding relation to the four vertical ridge lines of the signature stack to be laterally transported from the liftable table onto the turntable, the fences being openable and movable forward and rearward perpendicular to the lateral feed direction. The apparatus is then usable for handling signatures, e.g., of JIS B4 and B5 sizes.

According to another feature of the present invention, the apparatus further comprises removable fences mounted on the turntable and positioned in corresponding relation to or adjacent the four vertical ridge lines of the signature stack to be laterally transported from the liftable table onto the turntable, at least the fences positioned toward the liftable table being openable, rotary couplings for couplings on rotary shafts of the openable fences, the rotary couplings being mounted on the turntable and positioned in corresponding relation to or adjacent the four corners of each of signatures of at least two different sizes, and drive means for driving the rotary couplings. The apparatus is then usable for handling signatures, for example, of A3, A4 and A5 sizes.

These and other features of the present invention will be described below in greater detail with reference to the accompanying drawings, in which.

Throughout the drawings, like parts are designated by like reference numerals.

Figure 1:
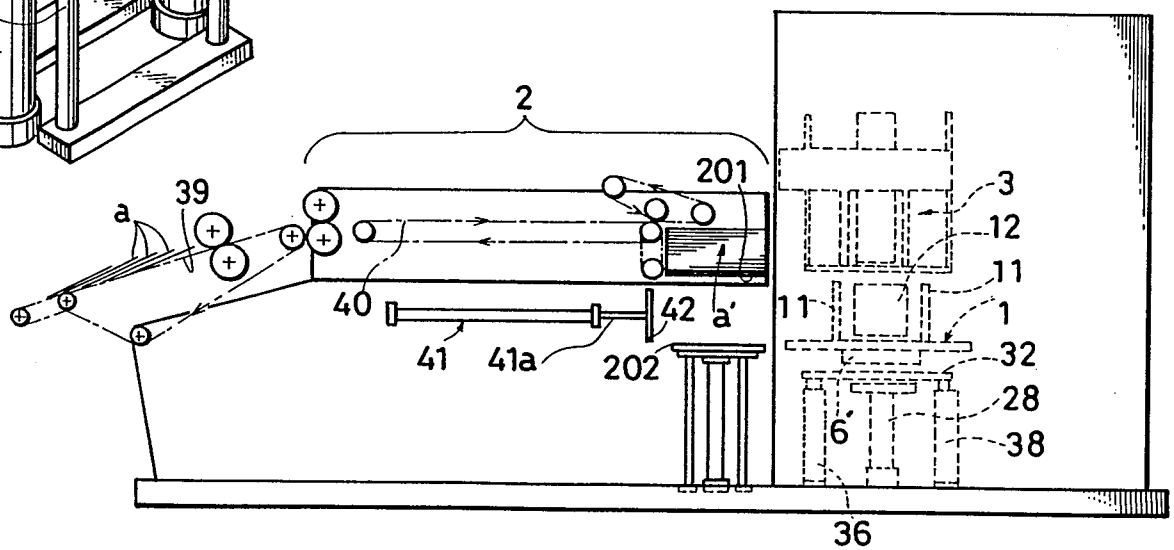
FIG. 1 is a side view showing an embodiment of the invention.
Figure 2:
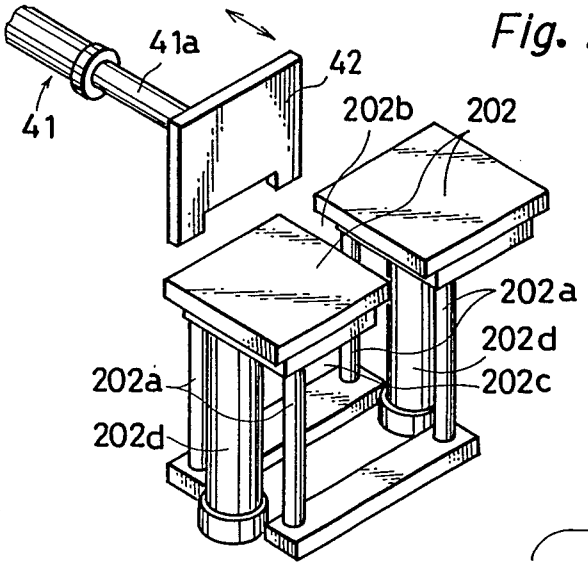
FIG. 2 is a perspective view showing a lift table and lateral feed means included in the apparatus of FIG. 1.
Figure 3:
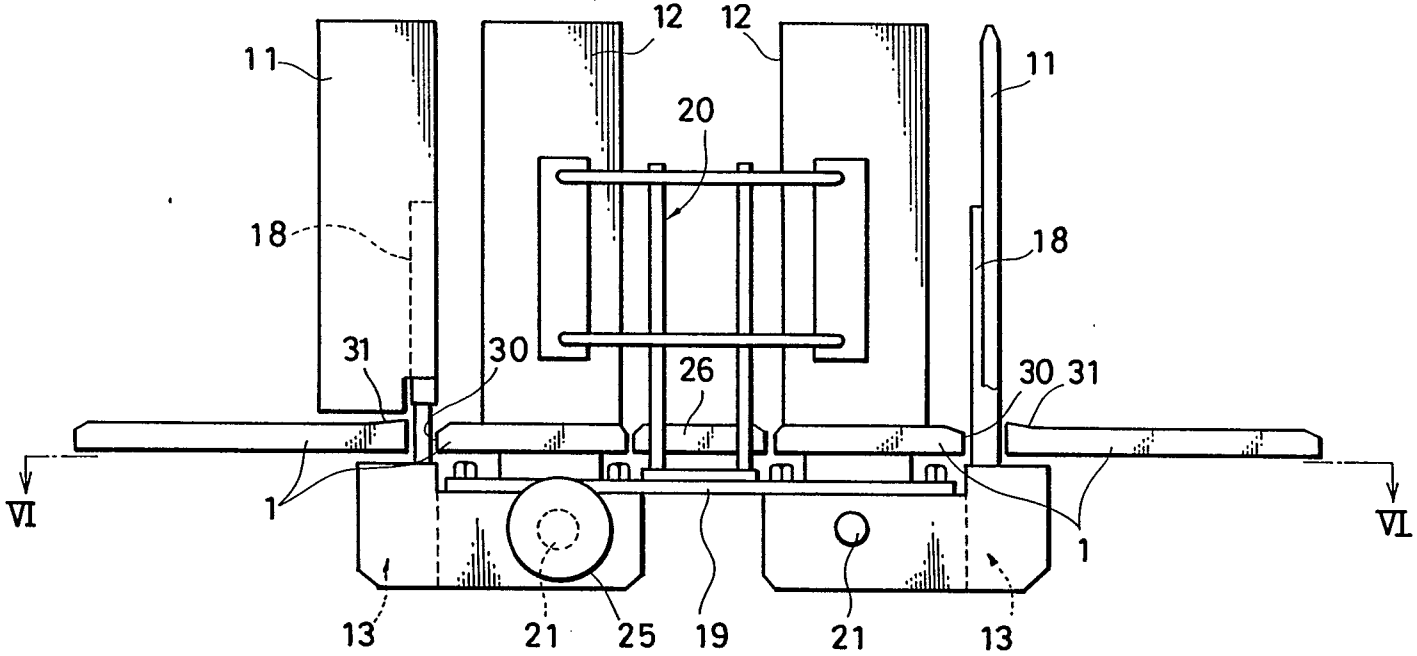
FIG. 3 is a side view showing a turntable included in the apparatus.

FIGS. 1 to 11 show a turntable 1, a signature stacking unit 2 provided in a fixed position and already known, and a known signature stack collecting unit 3 provided in a fixed position. The stacking unit 2 is provided with a shelf 201 which is movable leftward in FIG. 1. The turntable 1 is separate from a lift table 202 disposed below the shelf 201 and is disposed adjacent the lift table 202 at one side thereof toward which the stack of signatures to be described later and placed on the lift table 202 is pushed by a pusher 42 provided in a fixed position and serving as known lateral feed means. The turntable 1 is positioned below the stack collecting unit 3. The stacking unit 2 and the collecting unit 3 are schematically shown in FIG. 1. Hydraulic cylinder-plunger means 41 has a plunger 41*a* provided for the pusher 42 and positioned above the lift table 202. The lift table 202 comprises table members divided as at 202*b* so as to be liftable free of contact with the plunger 41*a* when the plunger 41*a* is positioned above the lift table 202. Each table member is in the form of a frame assembly including columns 202*a* and hydraulic cylinder-plunger means 202*d*. The table 202 has an internal space 202*c* between the table members for permitting the pusher 42 to retract from an advanced position without contacting the table 202 when the table 202 is in a raised position for receiving the stack of signatures from the stacking unit 2.

Signatures indicated at a in FIG. 1 are delivered for example, from a rotary press in the preceding process (not shown) onto the left end of a belt conveyor 39 as shown in FIG. 1, then divided into bundles of a specified number of signatures by a known method, thereafter transported on a belt conveyor 40 and stacked on, or received by, the shelf 201 included in the stacking unit 2 and retractable in the aforementioned direction.

The shelf 201 having the stack a' of signatures a placed thereon is retracted leftward in FIG. 1, whereby the stack a' is transferred onto the lift table 202. The table 202 is raised to the specified level before the retraction of the shelf 201.

The table 202 having the stack a' transferred thereto is then lowered to the solid-line position in FIG. 1, where it is stopped.

The stack a' is then laterally transferred from the table 202 to the turntable 1 as will be described later by the pusher 42.

The shelf 201, the table 202 and the pusher 42 are thereafter returned to their initial positions.

Signatures are divided into groups of specified number and then stacked, as mentioned above, repeatedly.

Figure 7:
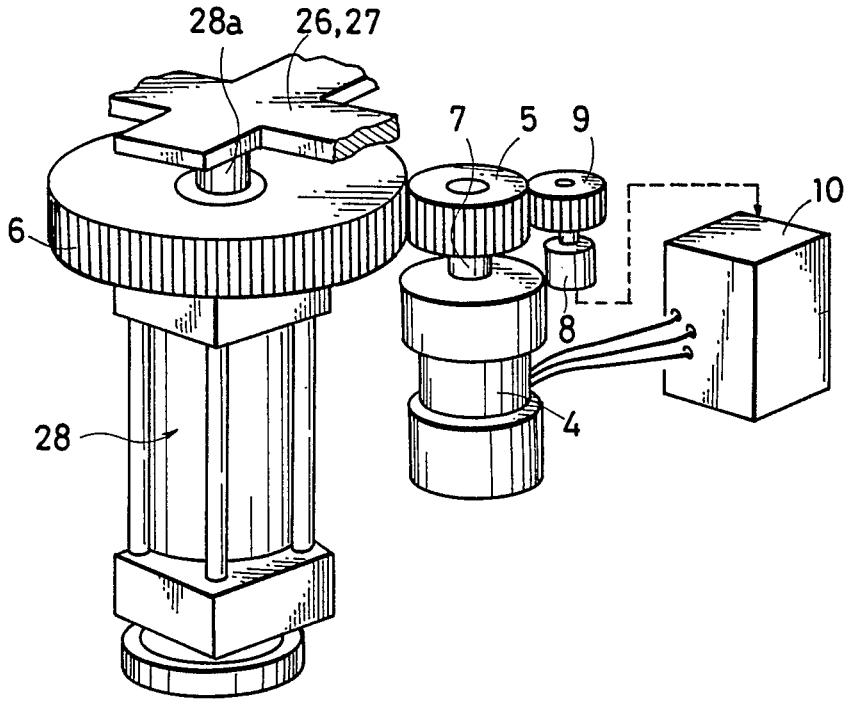
FIG. 7 is a perspective view showing an arrangement for rotating the turntable.
Figure 8:
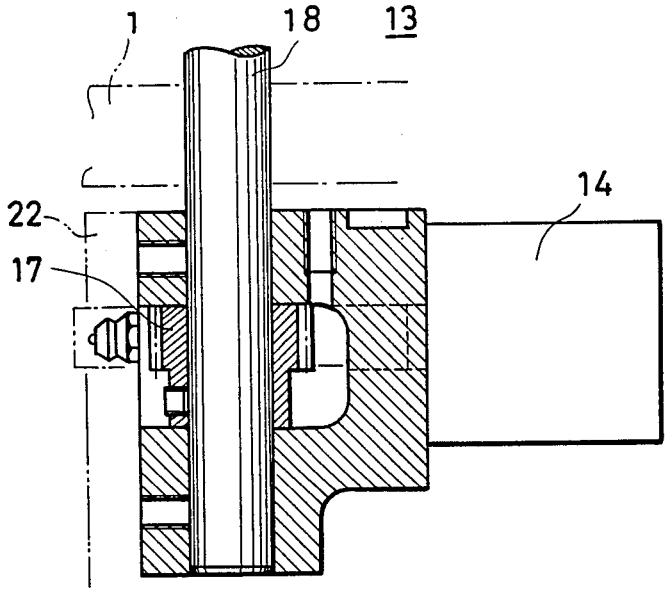
FIG. 8 is a front view partly in vertical section and showing a fence opening-closing mechanism included in the apparatus of FIG. 1.
Figure 9:
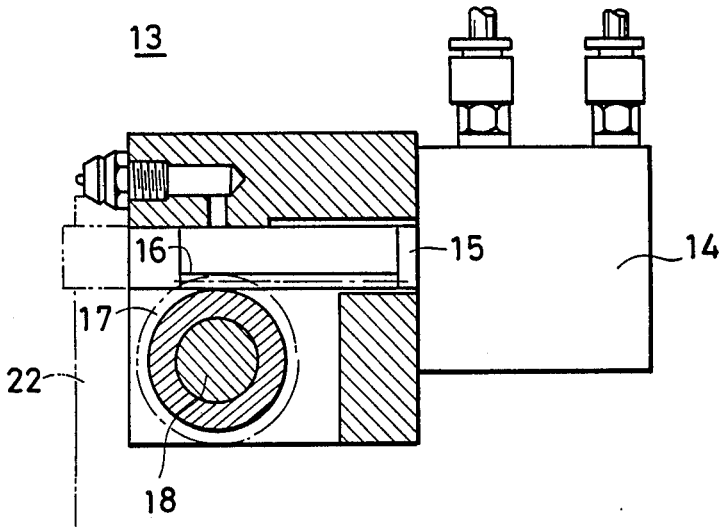
FIG. 9 is a plan view of the same.
Figure 10:
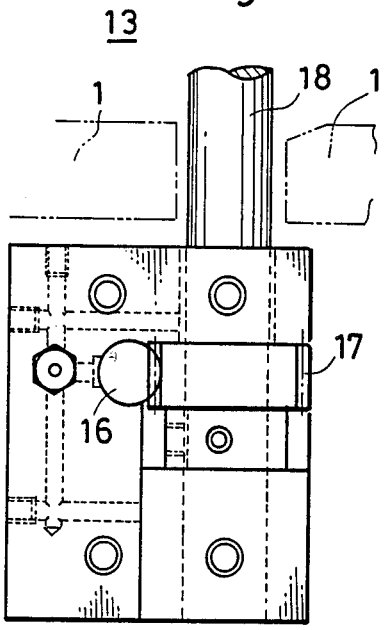
FIG. 10 is a side elevation of the same.

The turntable 1 is rotatable through transmission gears 5, 6 by a reversible motor 4 having a brake as shown in FIG. 7. The gear 5 is fixed to the shaft 7 of the motor 4, and the gear 6 to the turntable 1. A drive gear 9 for a cam-type switch 8 is in mesh with the gear 6. The switch 8 has a first actuator (not shown) for closing the switch when the gear 9 has rotated a number of revolutions or through a phase corresponding to the rotation of the turntable 1 through an angle slightly less than 180°, and a second actuator (not shown) for closing the switch when the gear 9 has rotated a number of revolutions or through a phase corresponding to the rotation of the turntable 1 through an angle slightly less than 90°. When turned on by these actuators, the switch 8 feeds a signal to an inverter 10 for the motor 4 for driving the turntable 1 to change the frequency given by the inverter 10 to a value for rotating the motor 4 at a speed lower than in the steady state, whereby the motor 4 is rotated at the lower speed, such that when the turntable 1 has been rotated through 180° or 90°, the motor 4 is deenergized and the brake for the motor 4 functions at the same time to stop the motor 4 and thereby stop the turntable 1 in position.

The turntable 1 is rotated through 180° for rotatingly reversing signatures of certain size, for example, JIS B5 size, in a horizontal direction. The turntable 1 is rotated through 90° for rotatingly reversing signatures of certain size, for example, JIS B4 size, in a horizontal direction. For the 180-degree rotation, the circuit including the second actuator of the switch 8 is held open, while for the 90-degree rotation, the first actuator of the switch 8 is held out of operation. To reverse the signature through 90°, the rotation of the motor 4 is so controlled as to displace the turntable 1 through 90° either clockwise or counterclockwise in FIG. 4. To reverse the signature through 180°, the turntable 1 is rotated in a desired direction.

The turntable 1 is provided with four fences 11 positioned in corresponding relation to the four vertical ridge lines of the signature stack placed on the table 1. Intermediate fences 12 are arranged between the fences 11 and 11 arranged in the direction A of acceptance of the stack to be described below. Each of the fences 11 is rotatable for opening and closing about a vertical axis. Each fence 11 has an opening-closing mechanism 13 shown in FIGS. 8 to 10. With reference to these drawings, the opening-closing mechanism 13 comprises a hydraulic cylinder 14 attached to a support 19 on the turntable 1 or to the fence 12, a rack 16 substantially integral with a rod 15 operable by the cylinder 14, and a pinion 17 meshing with the rack 16. The pinion 17 is drivingly connected to a rotary shaft 18 extending vertically from the fence 11.

Figure 4:
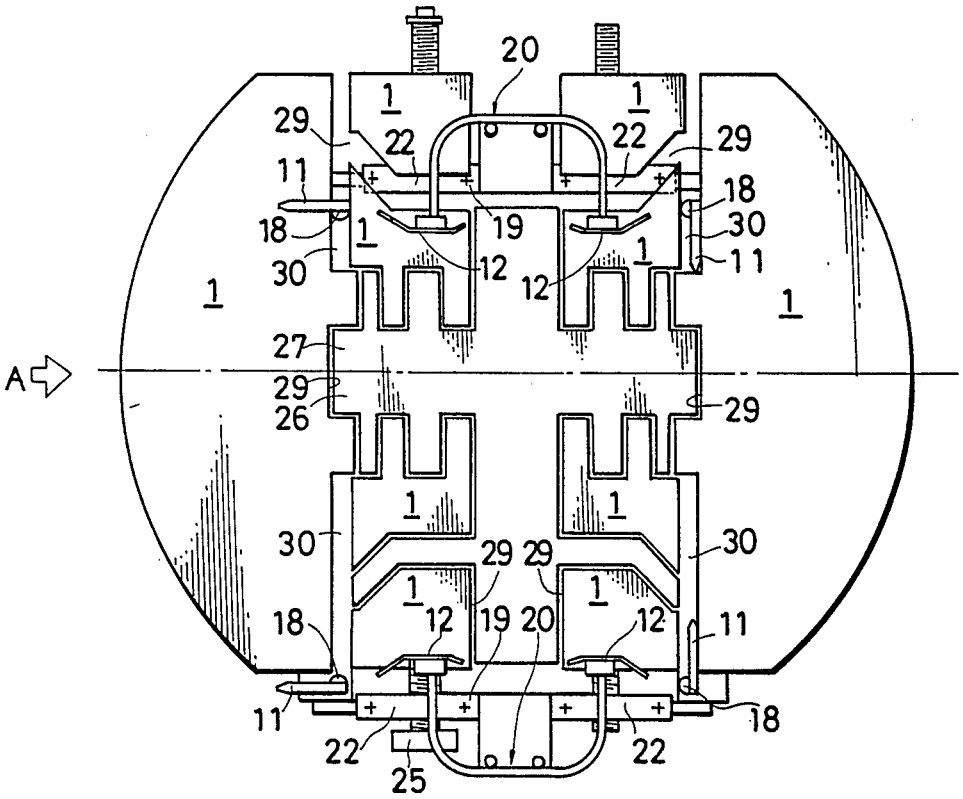
FIG. 4 is a plan view of the turntable.
Figure 5:
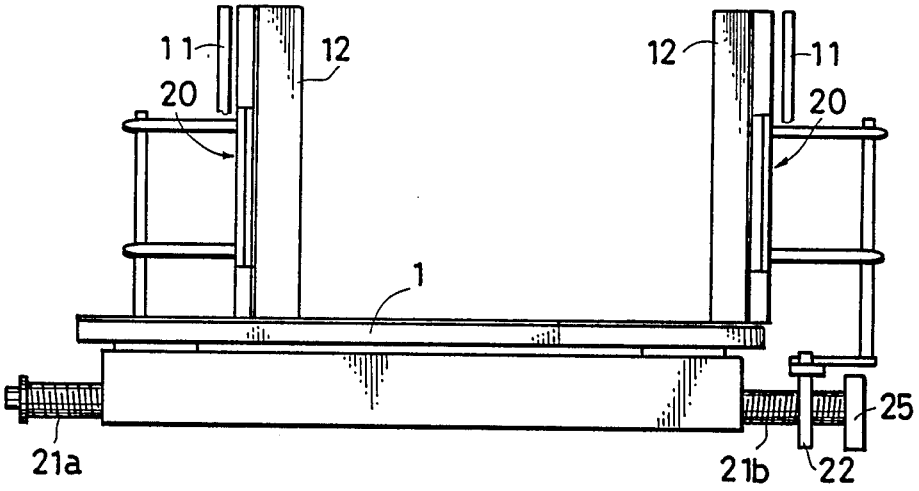
FIG. 5 is an elevation showing the turntable.
Figure 6:
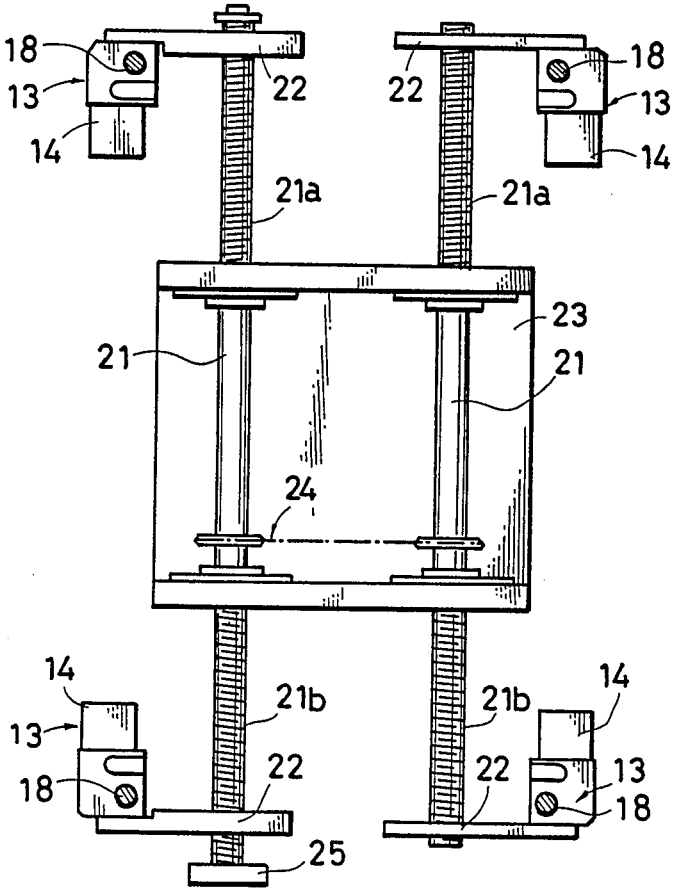
FIG. 6 is a view in section taken along the line VI—VI in FIG. 3.

With reference to FIG. 4, one pair of fences 11 and 11 arranged laterally side by side is opposed to the other pair of fences 11 and 11 similarly arranged. The two pairs are movable toward or away from each other relative to the turntable 1. The fences 12 are also arranged in opposed pairs, and the two pairs are similarly movable toward or away from each other relative to the turntable 1. Preferably, the pair of fences 11 and the pair of fences 12 adjacent thereto as arranged in the direction A are made so movable together as illustrated. These pairs of fences 11 and 12 are mounted on the corresponding one of the supports 19 and 19 mounted on the turntable 1, opposed to each other vertically in FIG. 4 and movable vertically in FIG. 4. Indicated at 20 is a bracket for the pair of fences 12. The supports 19 and 19 have nut portions 22, 22 and 22, 22 in screw-thread engagement with right-handed screw portions 21*a*, 21*a* and left-handed screw portions 21*b*, 21*b*, respectively, of screw rods 21 and 21 arranged side by side in FIG. 4 and extending vertically in FIG. 6. The screw rods 21 and 21 are supported by a frame 23 secured to the turntable 1 and are operatively connected together by chain-sprocket transmission means 24. One of the screw rods has a handle 25.

When the screw rods 21 and 21 are rotated forward or reversely by the handle 25, the supports 19 and 19 are advanced or retracted toward or away from each other (vertically in FIG. 4). With this movement, the pairs of fences 11 and 12 on each support 19 are moved in the same direction. The upper fences 11 and 12 in FIG. 4 are shown as positioned for signatures of JIS B4 size, while the lower fences 11 and 12 in FIG. 4 are positioned for signatures of JIS B4 size. The fences 11 and 12, which are mounted on the turntable 1, are movable with the turntable 1 when the table 1 is rotated.

Indicated at 26 and 27 are upward feed plates serving as means for upwardly feeding signatures. The upward feed plate 26 is shown in the lower half of FIG. 4 and is used for signatures of JIS B4 size. The upward feed plate 27, which is used for signatures of JIS B5 size, is shown in the upper half of FIG. 4. The desired one of these feed plates 26 and 27 is selected and attached to the plunger 28*a* of vertical hydraulic cylinder-plunger means 28. The plunger 28*a* is vertically slidable relative to the gear 6 which is fixed to the turntable 1 but is rotatable with the gear 6. The upward feed plate 26 or 27 as attached to the plunger 28*a* is fittable in a space 29 formed in the turntable 1, with its upper surface flush with the upper surface of the turntable 1, and is vertically movable through the space 29.

Indicated at 30 is a slot formed in the turntable 1 for rendering the rotary shaft 18 of the fence 11 movable vertically in FIG. 4 when the support 19 has the fence opening-closing mechanism 13 under the turntable 1. The slot 30 need not be provided if the fence opening-closing mechanism 13 is disposed on the upper side of or above the turntable 1 with the shaft 18 positioned above the table 1.

When the turntable 1 is formed with the slot 30, it is desirable that the portion of the turntable 1 defining the slot 30 and positioned away from the center of the table 1 be sloped upward toward the center as indicated at 31 to assure that the signature to be transferred onto the turntable 1 in the direction of arrow A as will be described later will pass over the slot 30 without permitting the forward end of the signature to engage in the slot 30.

The foregoing components are mounted on a frame 32. When required, the frame 32 is made movable forward or rearward in directions perpendicular to the direction A of acceptance of signatures by an arrangement shown in FIG. 11. The turntable 1 is schematically shown as a disk in FIG. 11.

Figure 11:
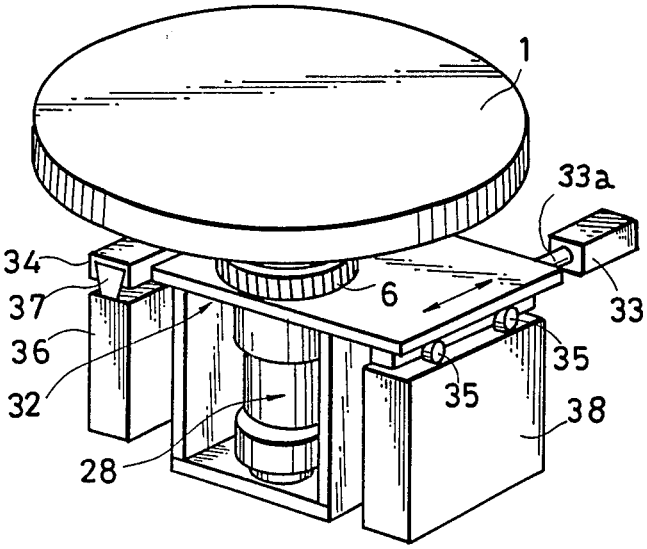
FIG. 11 is a perspective view of a system for forwardly and rearwardly moving the turntable in required directions to pile up signature stacks in a zigzag arrangement.
Figure 12:
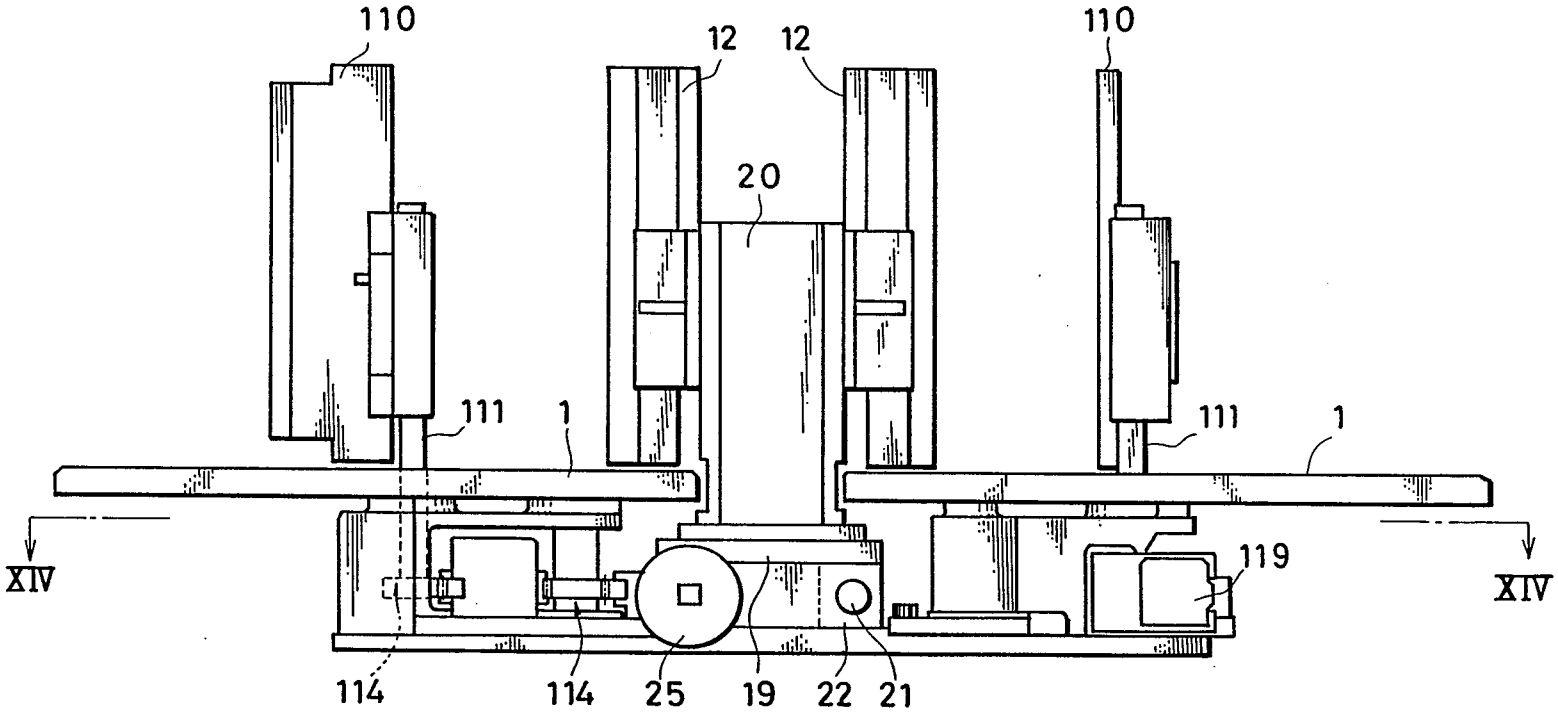
FIG. 12 is an elevation of a turntable included in a modified apparatus of the invention.

With reference to FIG. 11, hydraulic cylinder-plunger means 33 for moving the frame 32 forward or rearward has a plunger 33*a* connected to the frame 32. The frame 32 has a channel-shaped slider 34 and wheels 35. The slider 34 is fitted to a guide rail 37 mounted on a support 36 and extending in the desired direction. The wheels 35 are placed on a support 38.

The apparatus of the invention shown in FIGS. 1 to 11 operates as follows.

Before the turntable 1 receives a stack of signatures, a', the fences 11 at the stack inlet side (the left side in FIG. 4) are left open as shown in FIG. 4, and the fences 11 and 12 are positioned in conformity with the size of signatures a as already described. The fences 11 away from the inlet side (at the right side of FIG. 4) are closed as seen in FIG. 4. The closed fences 11 serve as stoppers for the stack a' to be received as will be described below. The fences 12 serve as side support members for the stack a' during receiving and also during rotation of the turntable 1.

The stack a' of signatures is transferred from one side of the turntable 1 (i.e. from the left side of FIG. 4) to the turntable 1 in this state toward the direction of arrow A, with the length of the signatures positioned vertically in FIG. 4 if they are of the size of JIS B4. The turntable 1 is then rotated by the motor 4 through 90° clockwise (or counterclockwise) in FIG. 4 and stopped. When required, the fences 11 and 11 which are initially open are closed before the rotation.

Subsequently, with the turntable 1 held in its stopped position, the upward feed plate 26 is moved to the specified level by the plunger 28*a* of the hydraulic cylinder-plunger means 28 and then stopped. The signature stack a' thus raised to the required level is handled by the stack collecting unit 3 in the conventional manner.

After transferring the stack to the collecting unit 3, the upward feed plate 26 is lowered to the predetermined position. The turntable 1 is rotated through 90° in a direction opposite to the previous direction, i.e. counterclockwise (or clockwise) in FIG. 4 so as to be ready to receive the next stack of signatures, a'.

Subsequently, the turntable 1 receives the second stack a', whereupon the table 1 is rotated through 90° in a direction opposite to the direction for the first stack. The stack is thereafter upwardly transferred to the collecting unit 3 in the same manner as already described.

In the same manner as above, the turntable 1 having a stack of signatures, a', received thereon is repeatedly operated to turn the stack horizontally through 90° each time.

When the stack a' is of the size of JIS B5, the stack is transferred to the turntable 1 with the length of the signatures positioned horizontally in FIG. 4, whereupon the turntable 1 is rotated through 180° and stopped (or held stopped without rotation). When required, the fences 11 and 11 at the inlet side, which are initially open are closed before the rotation of the turntable 1.

Subsequently, the stack a' on the turntable 1 is raised by the upward feed plate 27 to the position of the stack collecting unit 3 and is handled by the unit 3.

The upward feed plate 27 is lowered to the specified position after the stack has been transferred to the unit 3.

The fences 11 and 11 at the inlet side of the turntable 1 are then opened and the other fences 11 and 11 at the other side are closed to be ready for receiving the next stack of signatures, a'.

The second stack a' is transferred to the turntable 1 in this state, i.e. as displaced through 180° for the first stack (or as held in position without displacement).

The transferred stack a' is lifted toward the collecting unit 3 without displacing the turntable 1 through 180° (or after so displacing the table 1).

In the same manner as above, other signature stacks are reversed horizontally through 180° one after another FIGS. 12 to 15 show a modification of the apparatus of the present invention. The apparatus of FIGS. 12 to 15 has substantially the same construction as the one shown in FIGS. 1 to 11 with the exception of the following features. The turntable 1 is provided with fences 110 which are removable and which are arranged in corresponding relation to or adjacent to the four vertical ridge lines of the stack of signatures, a', received on the turntable 1. Each of these fences or each of at least those positioned toward the lift table 202 is movable about a vertical axis for opening and closing. When the four fences are positioned for opening and closing, rotary couplings 114 for coupling to the shafts 111, are arranged on the turntable 1 at locations corresponding to or adjacent to the four corners of each of the signatures of at least two different sizes, for example, of A3, A4, A5 and two-on type A5 (corresponding to A3 sheet as folded in two along its length). Drive means such as racks 115 and 116 are provided on the turntable 1 for driving the rotary couplings 114.

With the apparatus of FIGS. 12 to 15, the turntable 1 is rotatable through 180° for rotatingly reversing a stack of A4 signatures in a horizontal direction. The stack of A4 signatures is handled substantially in the same manner as already described for handling the stack of B5 signatures. The turntable 1 is rotated through 90° for rotatingly reversing a stack of signatures of A3, A5 or two-on type A5 size in a horizontal direction. The stack of each of these sizes is handled substantially in the same manner as already described for handling the stack of B4 signatures.

Figure 15:
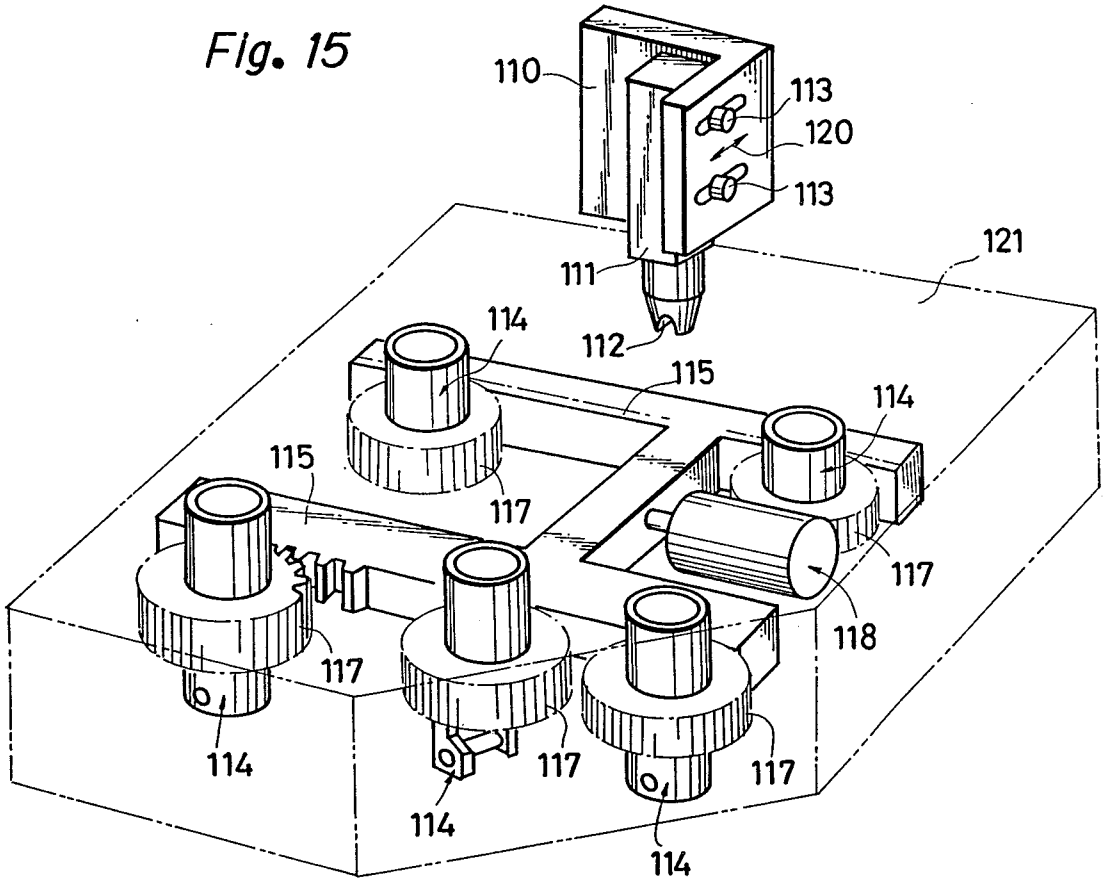
FIG. 15 is a perspective view showing couplings for opening and closing fences on the turntable of FIG. 12 and a drive system therefor.

The fence 110 is attached to the shaft 111 by setscrews 113, by which the position of the fence 110 is adjustable in the directions of arrows 120 in FIG. 15. The shaft 111 of the openable fence among the fences 110 is serviceable as a rotary shaft when the coupling 112 thereof is connected to the rotary coupling 114.

Figure 13:
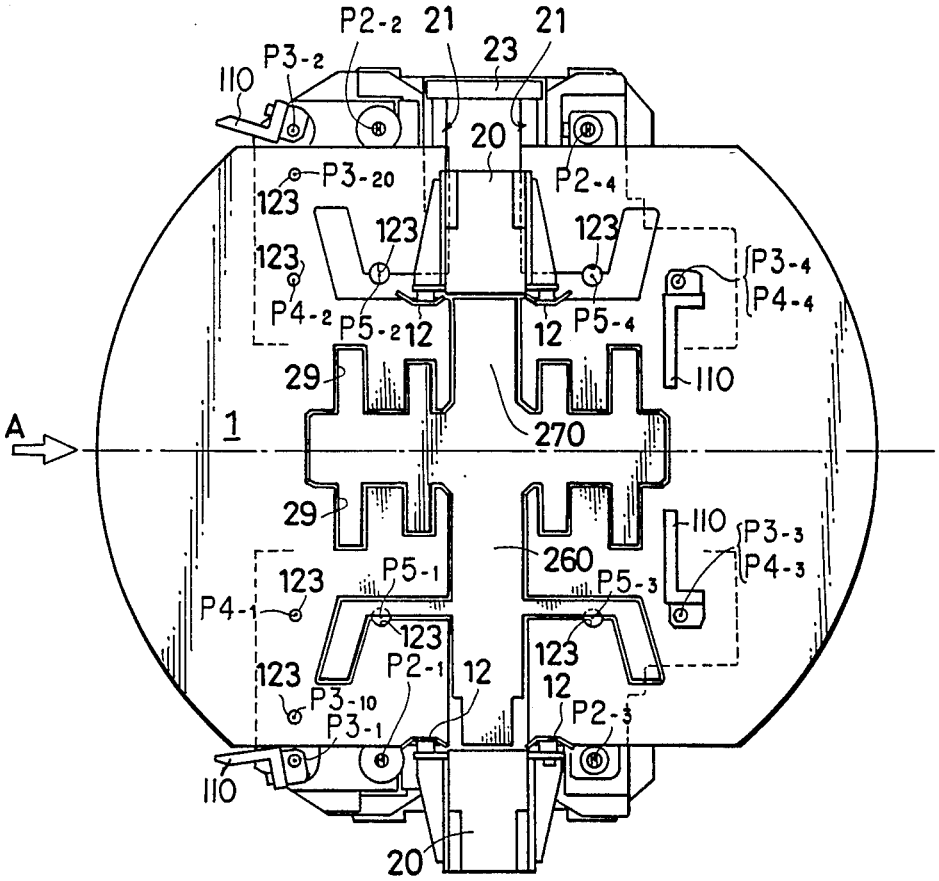
FIG. 13 is a plan view showing the turntable of FIG. 12.
Figure 14:
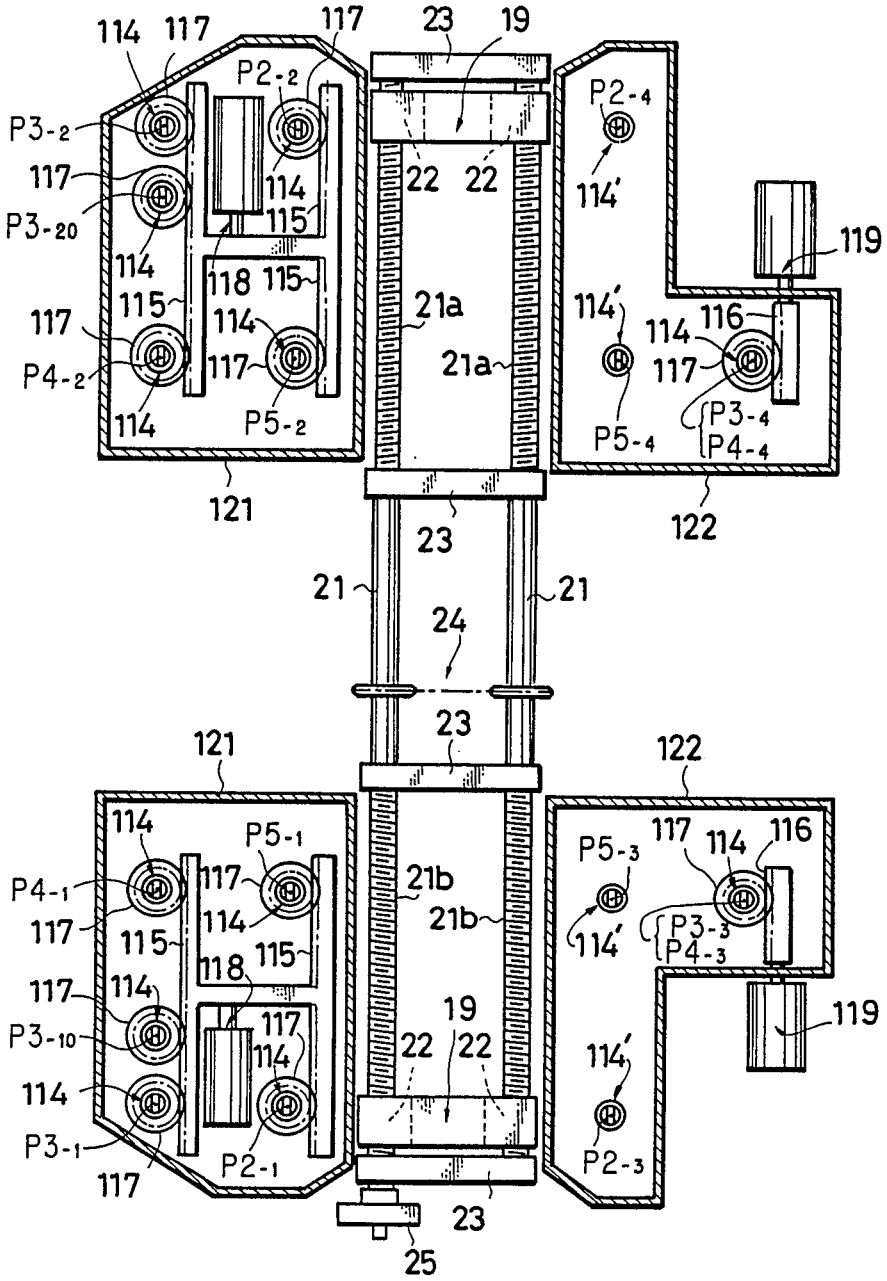
FIG. 14 is a view in section taken along the line XIV—XIV in FIG. 12.

With reference to FIGS. 13 and 14, couplings 114 are arranged in positions P3-1, P3-2, P3-3, P3-4 for A3 signatures, in positions P4-1, P4-2, P4-3, P4-4 for A4 signatures, in positions P5-1, P5-2, P5-3, P5-4 for A5 signatures and in positions P2-1, P2-2, P2-3, P2-4 for two-on type A5 signatures. Couplings 114 are further provided in positions P3-10 and P3-20 for A3 signatures. Of the fences 110, those which need not be openable may also have the same construction as the openable one, i.e. the same coupling as the coupling 112 on the shaft 111. The fences which need not be openable are those for the stacks of signatures to be transferred onto the turntable 1 in the direction of arrow A in FIG. 13 with the folds of the signatures positioned vertically in FIG. 13, i.e. the stack of A3 signatures, stack of A5 signatures and stack of two-on type A5 signatures. These fences are positioned on the right side of the vertical center line in FIG. 13. More specifically, these fences are those arranged in corresponding relation to the positions P3-3 and P3-4 for A3 signatures, those arranged in corresponding relation to the positions P5-3 and P5-4 for A5 signatures, and those arranged in corresponding relation to the positions P2-3 and P2-4 for two-on type A5 signatures. The couplings for coupling the fences which need not be openable are indicated at 114'. The coupling 112 on the shaft 111 is connectable to the coupling 114 or 114' by being inserted into the coupling 114 or 114' from above.

Each coupling 114 has a pinion 117 meshing with a rack 115 or 116. The rack 115 is movable by hydraulic cylinder-plunger means 118, while the rack 116 is movable by hydraulic cylinder-plunger means 119. The rack 115, the couplings 114 each having the pinion 117 meshing with the rack 115 and the cylinder-plunger means 118 are arranged within a box 121. The couplings 114', the rack 116, and the coupling 114 having the pinion 117 meshing with the rack 116 are housed in a box 122. The cylinder-plunger means 119 is attached to the box 122. The boxes 121 and 122 are fixed to the turntable 1. The turntable 1 and the boxes 121, 122 have holes 123 for the lower ends of the shafts 111 of the fences 110 to extend therethrough.

The rack 115, when moved, rotates the couplings 114 each having the pinion 117 meshing with the rack 115, consequently opening or closing the fence 110 whose shaft 111 is connected to one of the couplings 114. The rack 116, when moved, rotates the coupling 114 having the pinion 117 in mesh with the rack 116, opening or closing the fence 110 having the shaft 111 connected to the coupling 114.

FIG. 14 shows the overall arrangement including the fence opening-closing couplings and the drive means therefor. A portion of FIG. 14 is shown on an enlarged scale in FIG. 15. The system comprising the rack 116 and the pinion 117 meshing therewith has substantially the same construction as the system shown in FIG. 15 and comprising the rack 115 and the pinions 117 meshing therewith.

The apparatus of FIGS. 12 to 15 has upward feed plates 260 and 270 for upwardly transporting stacks of signatures. The upward feed plate 260, which is used for A3 and two-on type A5 signatures, is shown in the lower half of FIG. 13, while the upward feed plate 270 for A4 and A5 signatures is shown in the upper half of FIG. 13.

With the apparatus of FIGS. 12 to 15, the shafts 111 of the four fences 110 are connected to those of the couplings 114 and 114' which are positioned as specified for the stack of signatures to be handled.

With the apparatus of FIGS. 1 to 11 and the apparatus of FIGS. 12 to 15, the turntable 1 is moved, when required, with the frame 32 by the hydraulic cylinder-plunger means 33 forward and rearward by a specified amount as indicated by the arrows in FIG. 11 so that stacks of signatures of whatever size will be displaced from one another alternately in a zigzag arrangement as they are delivered from the turntable in succession.

The signature stacks further piled up by the collecting unit 3 are transferred from the unit 3 to a binding unit (not shown) subsequently connected thereto and bound with a band or the like in the known manner.

With either of the apparatus described above, the lift table 202 rises to a specified position to be ready to receive the subsequent stack of signatures while the pusher 42 remains in its advanced position or has not completely moved to its retracted limit position from the advanced position, such that the pusher 42 further retracts through the internal space **202*c* of the table 202**.

The apparatus of the invention may be used substantially in the same manner as described above for sheets which are not signatures for handling the sheets before binding.

We claim:

1. An apparatus for handling signatures before binding comprising a signature stacking unit for piling signatures delivered from a rotary press or the like in the preceding process into stacks of a given number of signatures, a liftable table disposed in a fixed position for receiving the stacks from the stacking unit, a stack collecting unit provided in a fixed position for piling up a number of signature stacks, lateral feed means for pushing the stack as placed on the table in a lateral feed direction to a position below the stack collecting unit, and a turntable rotatable through an angle of 180° in a direction about a vertical axis and reversibly rotatable through an angle of 90° in opposite directions about the axis for horizontally rotatingly reversing stacks of signatures to position the folds of the signatures of the stacks alternately at opposite sides in the order of piling before the stacks are piled up, the apparatus being characterized in that the liftable table is connected to hydraulic cylinder-plunger means for lifting the table which takes the form of a frame defining a space for passing the lateral feed means therethrough, the liftable table being of the divided type and upwardly and downwardly movable without contacting hydraulic cylinder-plunger means for driving the lateral feed means, the turntable being disposed in a position below the stack collecting unit and adjacent to the liftable table for receiving the signature stack laterally delivered from the liftable table by the lateral feed means, the turntable being provided with upward feed means for upwardly transporting the signature stack from the turntable to the position of the stack collecting unit.

2. An apparatus as defined in claim 1 further comprising fences mounted on the turntable and positioned in corresponding relation to the four vertical ridge lines of the signature stack laterally transported from the liftable table onto the turntable, the fences being openable and movable forward and rearward perpendicular to the lateral feed direction.

3. An apparatus as defined in claim 1 further comprising removable fences mounted on the turntable and positioned in corresponding relation to or adjacent the four vertical ridge lines of the signature stack to be laterally transported from the liftable table onto the turntable, at least the fences positioned toward the liftable table being openable, rotary couplings for couplings on rotary shafts of the openable fences, the rotary couplings being mounted on the turntable and positioned in corresponding relation to or adjacent the four corners of each of said signatures of at least two different sizes, and drive means for driving the rotary couplings.

4. An apparatus as defined in any one of claims 1 to 3 wherein the turntable is movable forward and rearward in directions perpendicular to or along the direction of lateral feed of the signature stack and is provided with means for moving the turntable forward and rearward.

* * * * *